US007861861B2

(12) United States Patent
Mesika

(10) Patent No.: US 7,861,861 B2
(45) Date of Patent: Jan. 4, 2011

(54) CONTAINER FOR HOLDING ELASTIC LOOPS THEREIN

(76) Inventor: Yigal Mesika, 7245 Hillside Ave., #310, Los Angeles, CA (US) 90046

( * ) Notice: Subject to any disclaimer, the term of this patent is extended or adjusted under 35 U.S.C. 154(b) by 256 days.

(21) Appl. No.: 11/732,679

(22) Filed: Apr. 4, 2007

(65) Prior Publication Data

US 2008/0245790 A1 Oct. 9, 2008

(51) Int. Cl.
*B65D 73/00* (2006.01)
*B65D 85/02* (2006.01)

(52) U.S. Cl. ..... 206/495; 206/476; 206/805

(58) Field of Classification Search ..... 206/476, 206/49, 227, 63.3, 395, 303, 805, 348, 388, 206/464, 474, 472, 485, 38, 338, 775, 495, 206/37; 242/613.3
See application file for complete search history.

(56) References Cited

U.S. PATENT DOCUMENTS 231,346 A * 8/1880 Neuburger ..... 206/49
1,441,266 A * 1/1923 Clune ..... 206/410
2,328,522 A * 8/1943 Yocum ..... 221/33
3,136,418 A * 6/1964 Stacy et al. ..... 206/63.3
3,869,044 A * 3/1975 Olsson et al. ..... 206/63.3
4,258,843 A * 3/1981 Wymer ..... 206/63.3
4,615,435 A * 10/1986 Alpern et al. ..... 206/63.3
5,197,597 A * 3/1993 Leary et al. ..... 206/63.3
5,277,299 A * 1/1994 Holzwarth et al. ..... 206/63.3
5,390,782 A * 2/1995 Sinn ..... 206/63.3
5,435,438 A * 7/1995 Scanlon ..... 206/63.3
5,584,164 A * 12/1996 Sinn ..... 53/430
5,775,504 A * 7/1998 Menaged ..... 206/495
5,819,919 A * 10/1998 O'Neal ..... 206/49

* cited by examiner

*Primary Examiner*—Steven A. Reynolds
(74) *Attorney, Agent, or Firm*—Risso & Associates; Marcus Risso

(57) ABSTRACT

A container for holding elastic loops is described. The container includes a foldable and substantially planar card. A foldable, substantially planar sheet is included for holding elastic loops. The sheet is formed such that it can be contained within the card. A separator is pivotally attached with the card. When an elastic loop is placed upon the sheet and the sheet is positioned upon the card, the separator covers a portion of the sheet such that it holds elastic loops against the sheet to allow the loops and sheet to be concealed within the card. For ease of storage and concealment, the card has a shape and size such that when folded, the card is of a substantially similar shape and size as a credit card for placement within a wallet.

5 Claims, 7 Drawing Sheets

CONTAINER FOR HOLDING ELASTIC LOOPS THEREIN

BACKGROUND OF THE INVENTION (1) Field of Invention

The present invention relates to a container, and more particularly to a card-shaped container that is formed to hold a plurality of elastic loops therein.

(2) Description of Related Art

Elastic loops have long been known in the art. By way of example, elastic loops are often considered rubber bands and used to hold items together. For example, rubber bands are typically associated with newspapers, as they hold the newspaper together and prevent it from becoming unraveled.

Expanding upon the rubber band concept, magicians have developed elastic loops that are barely visible and used for magic tricks. Such thin loops allow the magician to perform a variety of tricks while giving the appearance that no loop is present. For example, spreading the thin loop between two hands allows the magician to suspend an object thereon, while providing the illusion that the object is suspended mid air.

When storing such loops, they are typically placed in a box, purse, or other location that results in the loops becoming bunched up and otherwise disorganized. Additionally, due to the illusory nature of their business, it is desirable for magicians to be able to withdraw the barely visible elastic loop without much detection. In the very least, such magicians would need a convenient container to hold the loops in a convenient and organized manner.

Thus, a continuing need exists for a small and convenient container for holding elastic loops therein. The present invention fulfills such a need.

SUMMARY OF INVENTION

The present invention relates to a container for holding elastic loops therein. The container comprises a substantially planar card having a first portion and a second portion. A folding section exists between the first portion and second portion such that the card is foldable along the folding section. The container also includes a foldable, substantially planar sheet for holding elastic loops thereon. The sheet is formed such that it can be contained within the card.

In another aspect, a separator is pivotally attached with the card proximate the folding section, such that when the sheet is positioned upon the card, the separator is operative to cover a portion of the sheet such that it holds elastic loops against the sheet to assist it in folding when the card is being folded along the folding section.

In yet another aspect, the present invention includes elastic loops for placement over the sheet.

In yet another aspect, the separator is a substantially planar sheet that is affixed with the card such that a separator folding section exists between the card and the separator.

In another aspect, the sheet includes a plurality of notches for holding and separating a plurality of elastic loops.

Furthermore, the card has a shape and size such that when folded, the card is of a substantially similar shape and size as a credit card for placement within a wallet. Thus, a user can conceal the card and elastic loops within the wallet. As such, a user can place an elastic loop around the sheet and place the sheet within the planar card for storage therein.

Finally, as can be appreciated by one in the art, the present invention also comprises a method for forming and using the container described herein.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to a container, and more particularly to a card-shaped container that is formed to hold a plurality of elastic loops therein. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1) Description

The present invention relates to a container for holding elastic loops therein.

Figure 1:
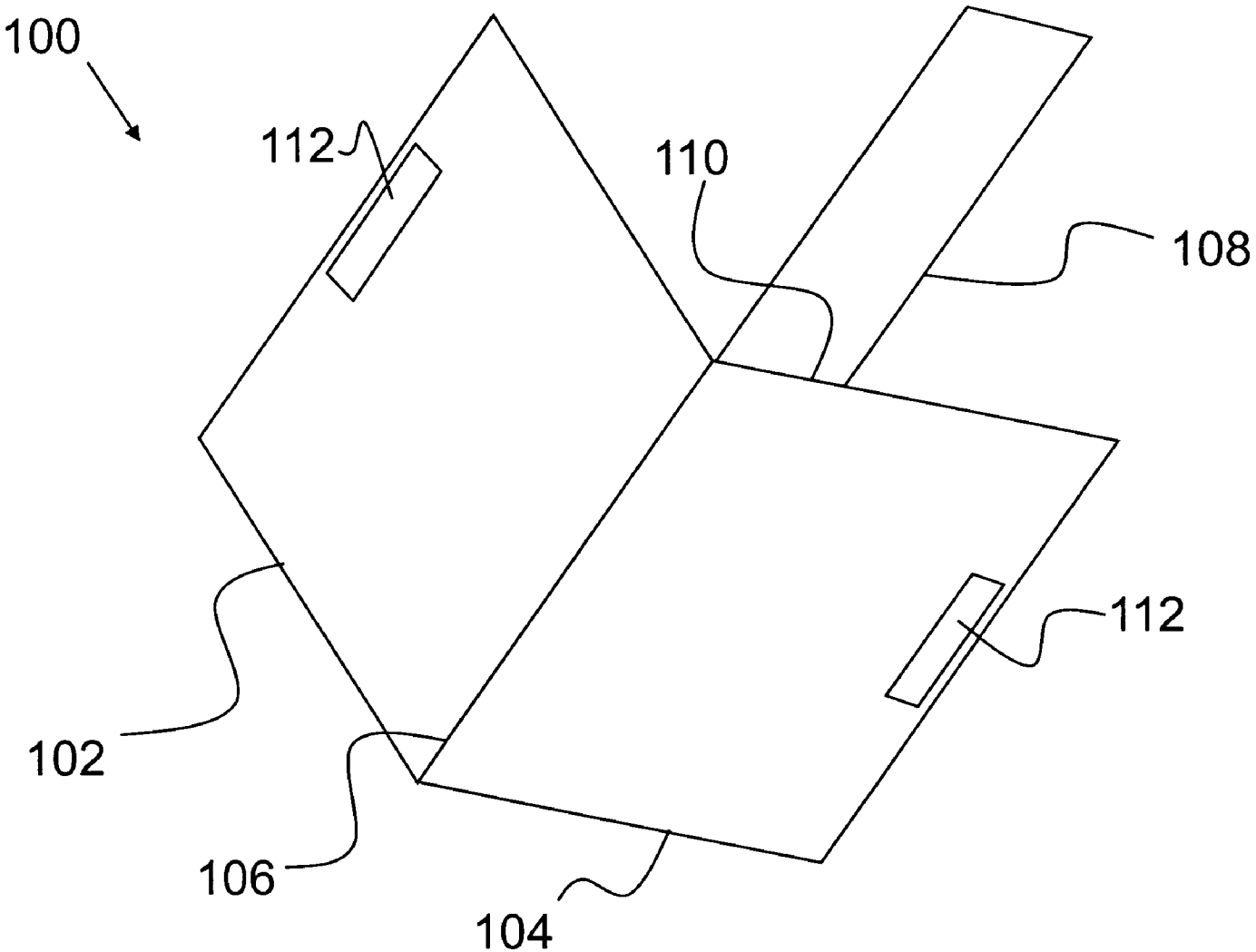
FIG. 1 is an illustration of a card according to the present invention.

As shown in FIG. 1, the container includes a card 100 having a first portion 102 and second portion 104. Each of the first and second portions 102 and 104 are substantially planar and are formed of a suitably rigid and durable material, non-limiting examples of which include plastic, metal, and paperboard. A folding section 106 separates the first and second portions 102 and 104 such that the card 100 is foldable along the folding section 106.

Also included is a separator 108. As can be appreciated by one skilled in the art, the separator 108 can be attached with either the first or second portion 102 and 104, so long as it is proximate the folding section 106. As described in further detail below, the separator 108 is used for holding the elastic loops against the card 100 (and proximate the folding section 106) when the card 100 is being closed. The separator 108 is any suitable mechanism or device for holding elastic loops proximate the folding section 106 and against the card 100. For example, the separator 108 can simply be a paper clip or any other detachably attachable item that can be used to easily affix the elastic loops against the card 100.

In another aspect, the separator 108 is permanently (and pivotally) affixed with the card 100 such that a separator folding section 110 exists between the card 100 and the separator 108. In this aspect, the separator 108 is any suitable protrusion that protrudes away from the card 100 and that can be folded back over the card 100 to hold elastic loops against the card. As a non-limiting example, the separator 108 is a substantially planar sheet. In this aspect, the separator 108 and the first and second portions 102 and 104 can be formed of the same planar sheet of material, with the corresponding folding sections therebetween.

Figure 7:
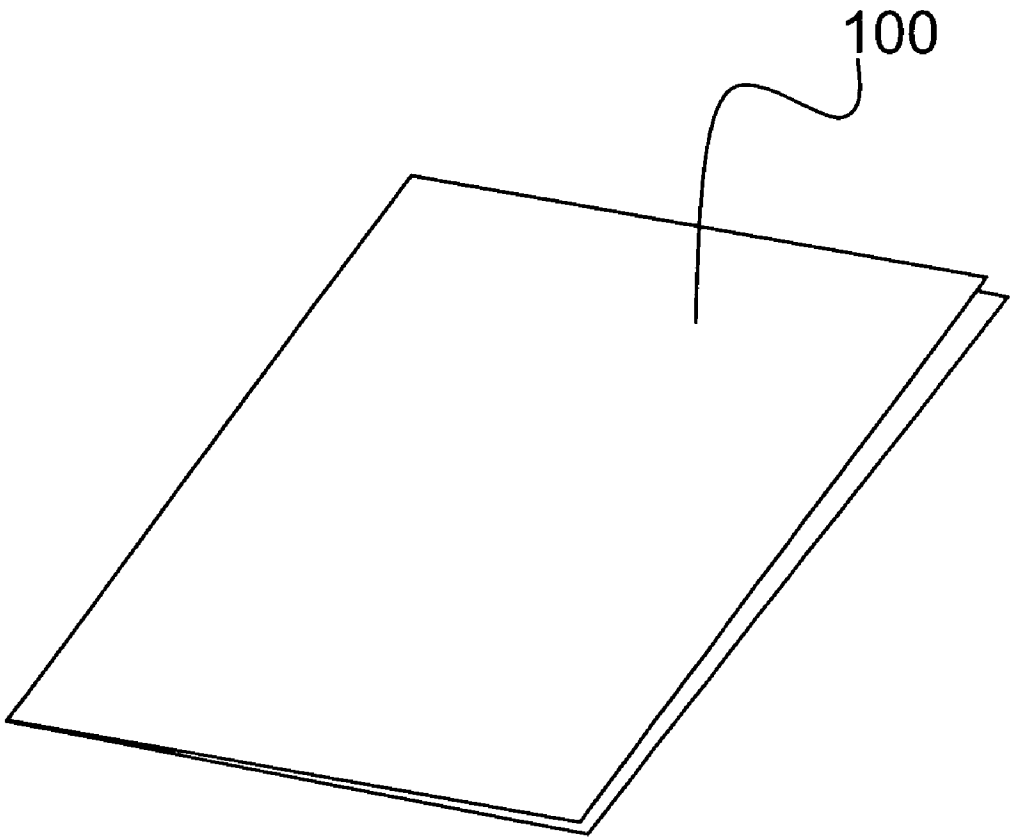
FIG. 7 is an illustration of the card as closed with the elastic loops held therein.

To maintain the first portion 102 and second portion 104 in a closed position (as illustrated in FIG. 7), a connector 112 is attached with either one of or both of the first and second portions 102 and 104. The connector 112 is any suitable mechanism or device for detachably attaching two objects together, non-limiting examples of which include hook and loop fasteners, magnets, and snaps. In another aspect, the connector 112 is a magnet on one of the portions, while a corresponding piece of metal is positioned on the other portion. In any configuration, the connector 112 effectively operates to hold the card 100 in a closed position so that any elastic loops therein remain affixed within the card 100.

Figure 2:
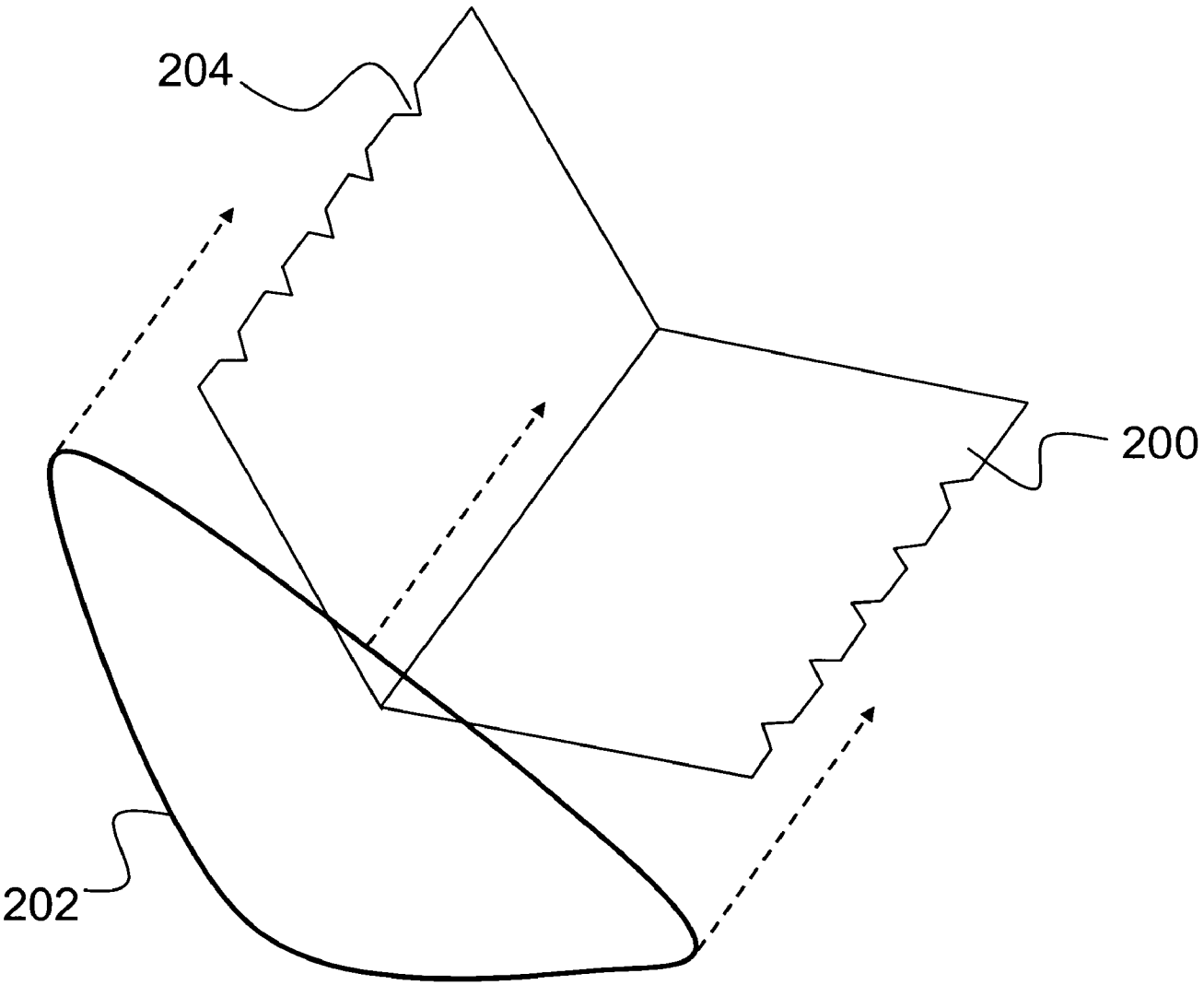
FIG. 2 is an illustration of a sheet for placement of an elastic loop thereon, according to the present invention.

FIG. 2 illustrates the sheet 200 for placement within the card. The sheet 200 is any suitable mechanism or device for holding elastic loops 202 thereon. As a non-limiting example, the sheet 200 is a foldable, substantially planar sheet. The sheet 200 is formed such that it can be contained within the card. In other words, a user can place the elastic loops 202 around the sheet 200 and place the sheet 200 within the planar card for storage therein. The sheet 200 is formed of any suitably planar material, non-limiting examples of which include paper and paperboard.

When placing multiple loops 202 around the sheet 200, it may be beneficial to include a separator for holding the loops 202 separate from one another. The separator is any suitable mechanism for holding an elastic loop 202 (or loops) affixed in place with respect to the sheet 200. As a non-limiting example, the separator includes a plurality of notches 204. In this aspect, the sheet 200 has a plurality of notches 204 to allow a user to place multiple loops 202 around the sheet 200, with each loop 202 being wrapped around its respective notch 204.

Figure 3:
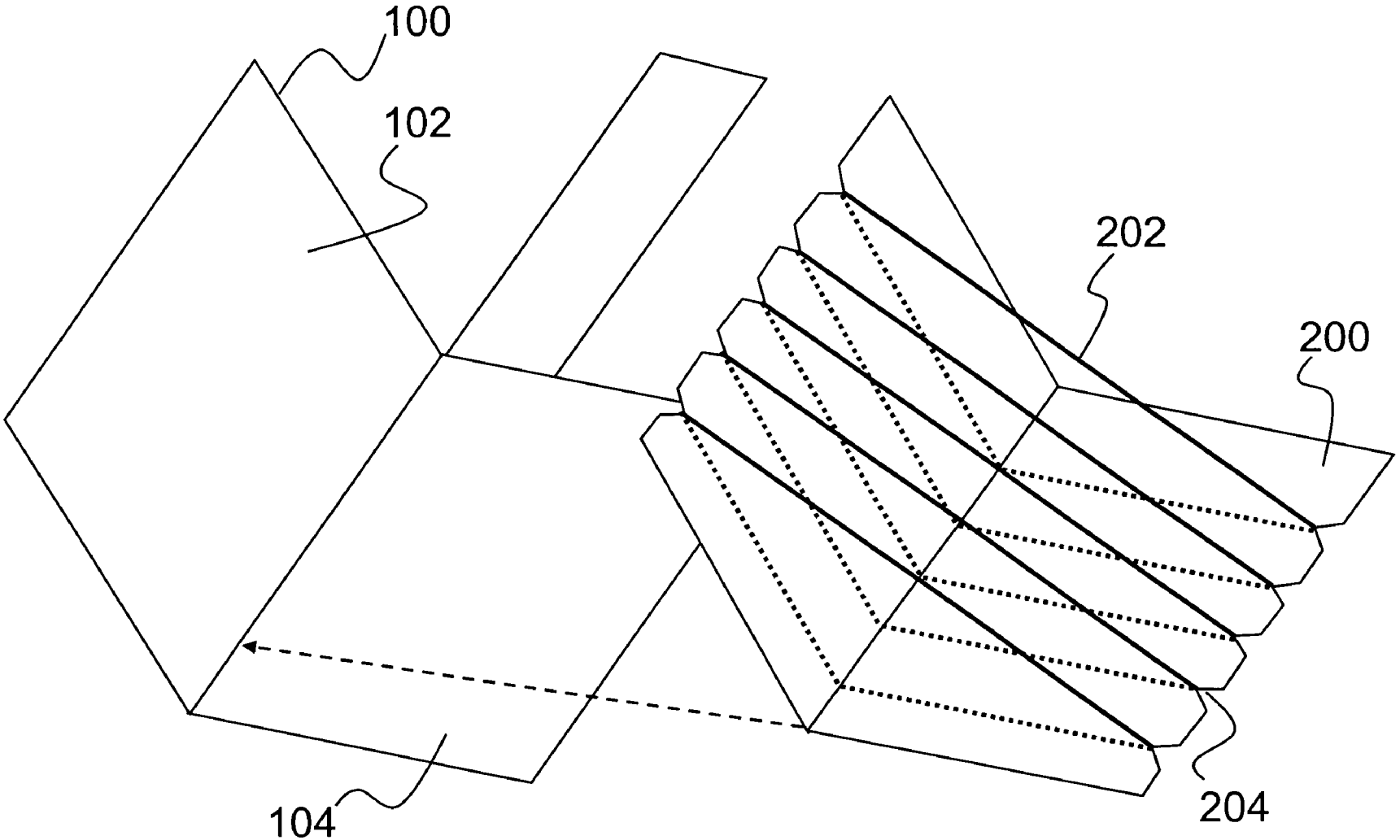
FIG. 3 is an illustration of the sheet being positioned within the card.

FIG. 3 illustrates the sheet 200 with a plurality of loops 202 wrapped around the sheet 200. As shown, each loop 202 is affixed with its corresponding notch 204. As can be appreciated by one skilled in the art, the notch 204 (or separator) is not necessary for operation of the present invention, but merely further facilitates the separation of multiple loops 202.

As can be appreciated by one skilled in the art, the sheet 200 is formed in any suitable shape and/or size such that it can be contained within the first and second portions 102 and 104 for easy placement within the card 100. In another aspect (not illustrated), the sheet 200 is pivotally connected with the card 100 along one of its edges such that it can fold in-and-out from an interior of the card 100.

Figure 4:
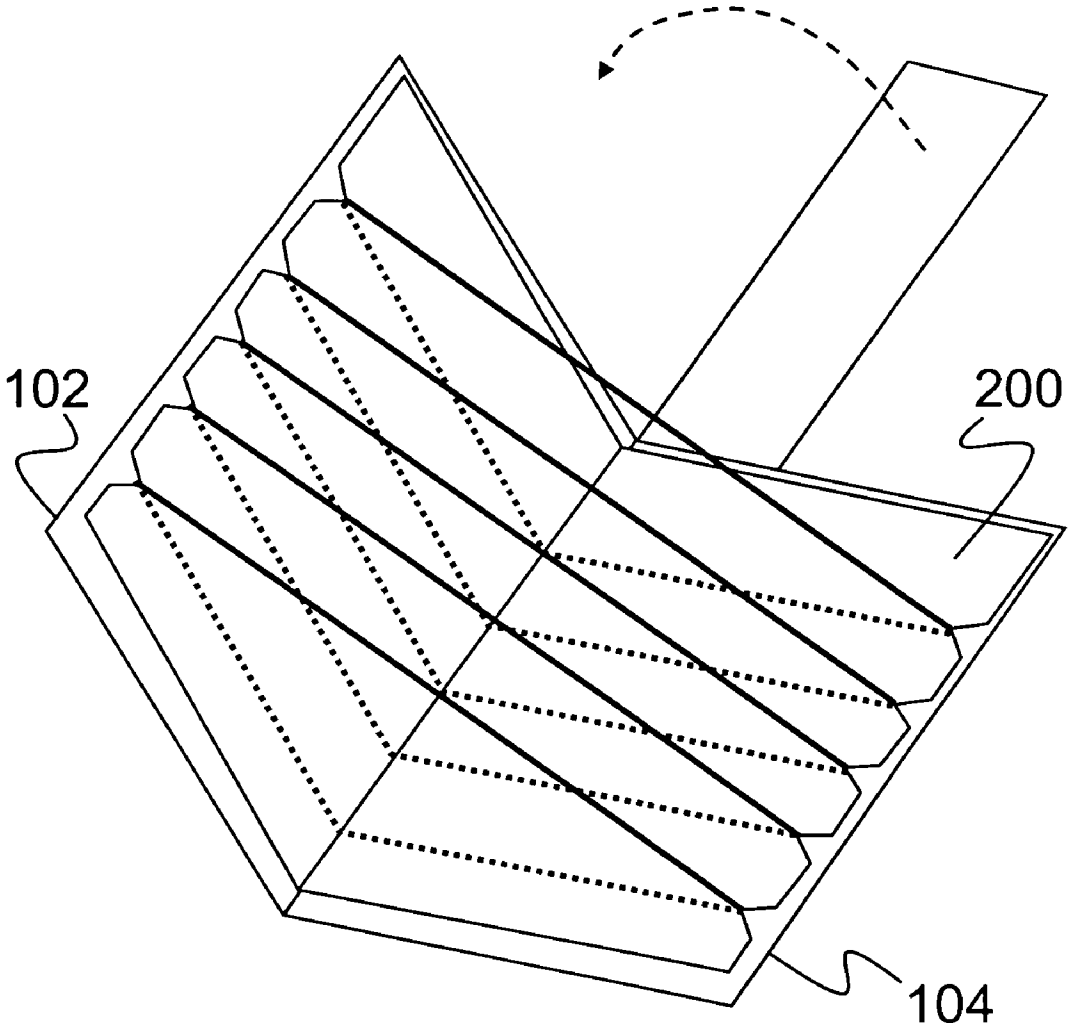
FIG. 4 is an illustration of a separator that is attached with the card being folded over the elastic loops positioned upon the sheet.
Figure 5:
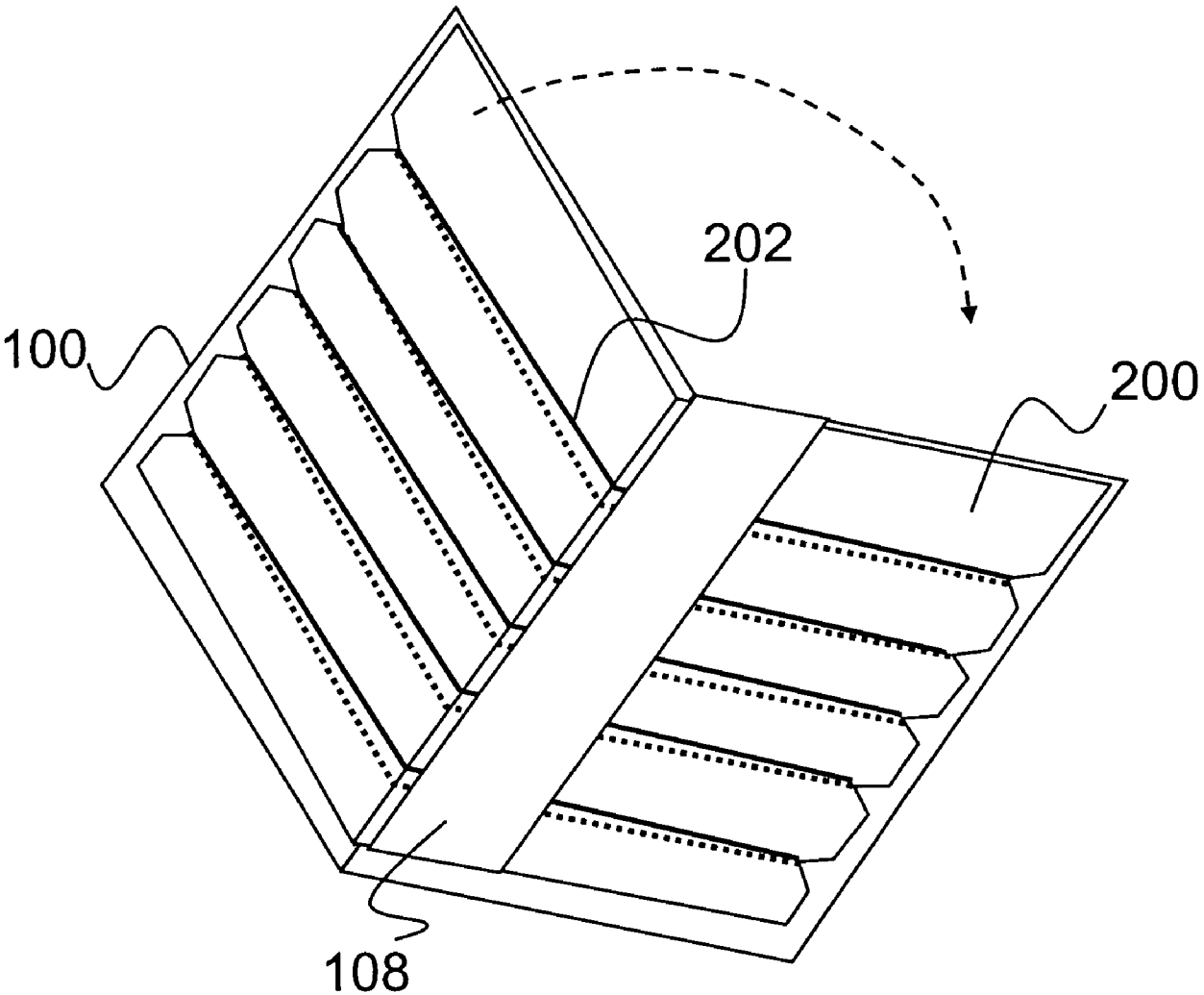
FIG. 5 is an illustration of the card being closed with the elastic loops and sheet therein.

FIG. 4 illustrates the sheet 200 as placed between the first and second portions 102 and 104. As illustrated in FIG. 5, once the sheet 200 is placed against the card 100, the separator 108 can be used to hold the elastic loops 202 against the card 100.

Figure 6:
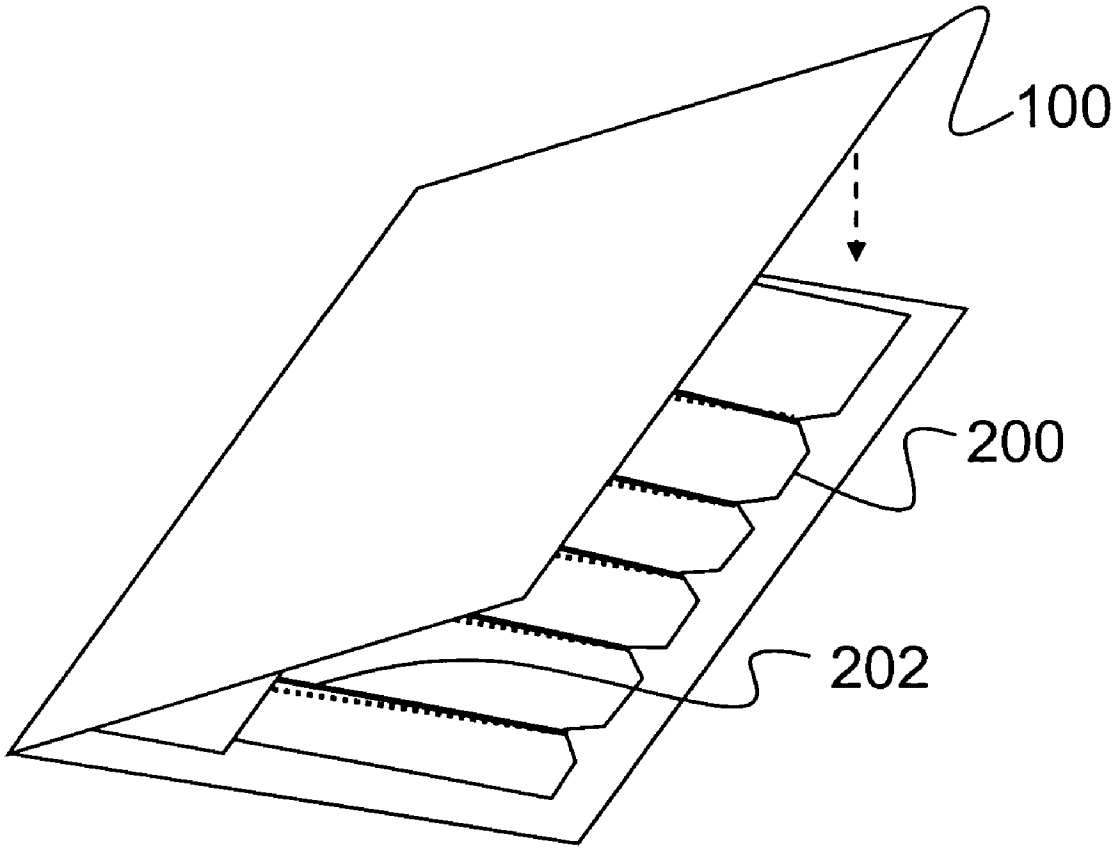
FIG. 6 is an illustration of the card being further closed for encasing the elastic loops therein.

FIG. 6 illustrates the card 100 being closed, with the sheet 200 and elastic loops 202 therein. As illustrated, the card 100 is closed by closing the first and second portions 102 and 104 against one another.

Finally, FIG. 7 illustrates the card 100 in a closed position. In one aspect, the card 100 with the sheet and elastic loops therein, is approximately the size of a credit card when closed. In this aspect, a magician or other user can easily carry the present invention within the user's wallet, thereby allowing the user to conceal the elastic loops therein. Such a benefit provides magicians and others with the ability to easily carry elastic loops while providing the illusion that no such container is being carried.

What is claimed is:

1. A container for holding elastic loops, comprising:

a substantially planar card having a first portion and a second portion, with a folding section therebetween, such that the card is foldable along the folding section;

a foldable, substantially planar sheet for holding elastic loops thereon, the sheet being formed such that it has two opposing sides having a fold line therebetween and can be folded along the fold line and contained within the card, whereby a user can place an elastic loop around the sheet, fold the sheet along the fold line, and place the sheet within the planar card for storage therein;

wherein the sheet has a perimeter with a plurality of notches on the perimeter of the opposing sides for holding and separating a plurality of elastic loops, wherein the fold line runs between the plurality of notches such that it is approximately parallel to at least a portion of the two opposing sides having the plurality of notches;

wherein the card has a shape and size such that when folded, the card is of a substantially similar shape and size as a credit card for placement within a wallet, thereby allowing a user to conceal the card and elastic loops within the wallet, and a separator pivotally attached with the card proximate the folding section, such that when the sheet is positioned upon the card, the separator is operative to cover a portion of the sheet such that it holds elastic loops against the sheet to assist it in folding when the card is being folded along the folding section.

2. A container as set forth in claim 1, wherein the separator is a substantially planar sheet that is affixed with the card such that a separator folding section exists between the card and the separator.

3. A container as set forth in claim 1, further comprising elastic loops for placement over the sheet;

wherein the plurality of notches comprise five notches on each opposing side; and wherein five elastic loops are positioned across the notches.

4. A container for holding elastic loops, comprising:

a substantially planar card having a first portion and a second portion, with a folding section therebetween, such that the card is foldable along the folding section;

a foldable, substantially planar sheet for holding elastic loops thereon, the sheet being formed such that it has two opposing sides having a fold line therebetween and can be folded along the fold line and contained within the card;

a separator pivotally attached with the card proximate the folding section, such that when the sheet is positioned upon the card, the separator is operative to cover a portion of the sheet such that it holds elastic loops against the sheet to assist it in folding when the card is being folded along the folding section;

elastic loops for placement over the sheet;

wherein the separator is a substantially planar sheet that is affixed with the card such that a separator folding section exists between the card and the separator;

wherein the sheet has a perimeter and includes a plurality of notches on the perimeter of the opposing sides for holding and separating a plurality of elastic loops, wherein the fold line runs between the plurality of notches such that it is approximately parallel to at least a portion of the two opposing sides having the plurality of notches; and wherein the card has a shape and size such that when folded, the card is of a substantially similar shape and size as a credit card for placement within a wallet, thereby allowing a user to conceal the card and elastic loops within the wallet, whereby a user can place an elastic loop around the sheet and place the sheet within the planar card for storage therein.

5. A container for holding elastic loops, comprising:

a substantially planar card having a first portion and a second portion, with a folding section therebetween, such that the card is foldable along the folding section;

a foldable, substantially planar sheet for holding elastic loops thereon, the sheet being formed such that it has two opposing sides having a fold line therebetween and can be folded along the fold line and contained within the card;

a separator pivotally attached with the card proximate the folding section, such that when the sheet is positioned upon the card, the separator is operative to cover a portion of the sheet such that it holds elastic loops against the sheet to assist it in folding when the card is being folded along the folding section;

elastic loops for placement over the sheet;

wherein the card has a shape and size such that when folded, the card is of a substantially similar shape and size as a credit card for placement within a wallet, thereby allowing a user to conceal the card and elastic loops within the wallet, whereby a user can place an elastic loop around the sheet and place the sheet within the planar card for storage therein; and wherein the sheet has a perimeter and includes a plurality of notches on the perimeter of the opposing sides for holding and separating a plurality of elastic loops, wherein the fold line runs between the plurality of notches such that it is approximately parallel to at least a portion of the two opposing sides having the plurality of notches.

* * * * *